US006189579B1

(12) United States Patent
Tanaka

(10) Patent No.: US 6,189,579 B1
(45) Date of Patent: Feb. 20, 2001

(54) GAS FILLING METHOD AND DEVICE, AND METHOD FOR FILLING DISCHARGE GAS INTO PLASMA DISPLAY PANEL

(75) Inventor: Yoshito Tanaka, Tokyo (JP)

(73) Assignee: NEC Corporation, Tokyo (JP)

( * ) Notice: Under 35 U.S.C. 154(b), the term of this patent shall be extended for 0 days.

(21) Appl. No.: 09/312,890

(22) Filed: May 17, 1999

(30) Foreign Application Priority Data

May 21, 1998 (JP) ..... 10-139320

(51) Int. Cl.[7] ..... B65B 31/00; H01J 9/38

(52) U.S. Cl. ..... 141/8; 141/11; 141/66; 141/82; 141/85; 445/40

(58) Field of Search ..... 141/1, 4, 5, 7, 141/8, 11, 65, 66, 82, 85, 89; 445/40, 41, 73

(56) References Cited

U.S. PATENT DOCUMENTS

| | | | |
|---|---|---|---|
| 1,732,336 | 10/1929 | Lohman | 141/8 |
| 3,178,864 | 4/1965 | Anderson et al. | 53/428 |
| 5,499,939 | 3/1996 | Itoh et al. | 445/73 |

FOREIGN PATENT DOCUMENTS

| | | |
|---|---|---|
| 55 59631 | 5/1980 | (JP) . |
| 61-264654 | 11/1986 | (JP) . |
| 63 26924 | 2/1988 | (JP) . |
| 4-269425 | 9/1992 | (JP) . |
| 5234512 | 9/1993 | (JP) . |
| 10 334816 | 12/1998 | (JP) . |
| 11 2040306 | 7/1999 | (JP) . |

*Primary Examiner*—Henry J. Recla
*Assistant Examiner*—Peter deVore
(74) *Attorney, Agent, or Firm*—Young & Thompson

(57) ABSTRACT

A pipe is connected to a panel of a plasma display panel. Non-porization type getters are arranged in the pipe. The panel, getters, and a portion of the pipe located between the panel and the gatters are heated. The inner space of the heated panel is evacuated through the heated pipe. After evacuation, the heating is stopped and the panel is cooled. A discharge gas is introduced into the panel through the pipe. The impurity gases contained in the discharge gas are absorbed and removed by the activated getters which is actavated by the heat. During the evacuation, impurity gases are not absorbed in the inner wall of the heated portion of the pipe. Therefore, no impurity gases are mixed to the discharge gas whose impurity gases are absorbed by the getters. Therefore, no impurity gases are introduced into the panel. After the panel is filled with the discharge gas, the pipe is cut and sealed.

21 Claims, 5 Drawing Sheets

GAS FILLING METHOD AND DEVICE, AND METHOD FOR FILLING DISCHARGE GAS INTO PLASMA DISPLAY PANEL

This application is based on Japanese Patent Application No. 10-139320 filed May 21, 1998, which is incorporated herein by reference in its entirety.

BACKGROUND OF THE INVENTION

1. Field of the Invention

The present invention relates to a method for manufacturing a plasma display panel and particularly to a method for exhausting gas in a panel to fill discharge gas thereinto.

2. Description of the Related Art

A plasma display panel (hereinafter referred to as a PDP) is filled with discharge gas. To stabilize a discharge characteristic of the PDP, to reduce a driving voltage, and lessen a change in the discharge characteristic with time, the degree of purity of the discharge gas filled into the PDP must be enhanced.

To enhance the degree of purity of the discharge gas, the discharge gas is filled into the PDP by the following way.

First, a vent pipe is connected to a panel (cell) of the PDP. Next, the panel is heated and the interior of the panel is evacuated through the vent pipe so as to remove impurity gases such as water, nitrogen gas, carbon dioxide gas, etc. After removing impurity gases, the discharge gas is filled into the panel through the vent pipe, and finally the vent pipe is sealed.

However, in the aforementioned method, discharge gas is charged to the panel through the vent pipe where the impurity gases have been exhausted. For this reason, impurity gases adhered and absorbed on an inner wall of the vent pipe at an exhausting time are mixed into the discharge gas at the time of filling discharge gas into the panel with the result that impurity gases enter the interior of the panel again. Therefore, the mixing of impurity gases into the discharge gas cannot be prevented.

In order to reduce the amount of impurity gases in the discharge gas, there is proposed a gettering method in which impurity gases of the cell are absorbed by a getter formed of a ZrAl (zirconium aluminum) alloy, etc.

For example, Published Unexamined Japanese Patent Application (Kokai) No. Hei 4-269425 discloses a PDP manufacturing method having the following processes.

(1) A vent pipe having a getter in its interior is attached to a panel;

(2) The interior of the panel is exhausted to a vacuum state through the vent pipe;

(3) Discharge gas is introduced into PDP through the vent pipe;

(4) The vent pipe is chipped off (sealing due to heat-melting, cutting); and (5) The panel is heated to diffuse mercury into the panel. During the use of the PDP, the getter absorbs impurity gases existing in the PDP as well as at an internal gas exhausting time, and a discharge gas introducing (filling) time.

Also, Published Unexamined Japanese Patent Application (Kokai) No. Sho 61-264654 discloses a gas filling method having the following processes though this relates to a technique of a plate-like fluorescent lamp.

(1) A vent pipe having a getter in its interior is connected to the fluorescent lamp;

(2) The interior of the fluorescent lamp is exhausted through the vent pipe;

(3) Discharge gas is introduced into the interior of the fluorescent lamp;

(4) The vent pipe is chipped off; and (5) The getter is heated to diffuse mercury therefrom. The getter absorbs impurity gases existing in a fluorescent lamp during the use of the lamp as well.

However, if the method disclosed in Published Unexamined Japanese Patent Application No. Hei 4-269425 and the technique disclosed in Published Unexamined Japanese Patent Application No. Sho 61-264654 are applied to the PDP manufacture, the following problems will occur:

(1) The getter is left in the completed the PDP.

(2) In the PDP, the inner space of the panel is divided by walls into a plurality of discharge spaces each of which forms a picture element. For this reason, the gas flow worsens, and complete exhaust of impurity gases is difficult to be carried out. As a result, there is a high possibility that impurity gases will be left in the PDP.

(3) In addition to the point that the interior of the PDP is divided by the wall, discharge gas pressure in the PDP is high. For this reason, the gas circulation in the PDP worsens. Although the impurity gases are removed by absorption in the portion close to the getter, no absorption of impurity gases occurs in the portion away from the getter, and impurity gases are left as they are. For this reason, there is a case in which the driving voltage and luminance and brightness become unequal due to influence of impurity gases when an image is displayed using the PDP.

SUMMARY OF THE INVENTION

It is an object of the present invention to provide method and device for filling gas containing less impurity gases to cells or panels.

It is further object of the present to provide a method for filling a plasma display panel with discharge gas without distribution of gas components.

In order to achieve the above object, according to a first aspect of this invention, there is provided a method for filling gas into a cell, comprising:

heating a cell to which at least one pipe where getters are arranged in a line is connected, and at least a portion of the pipe located between the cell and getters;

exhausting the interior (or evacuating the inner space) of the heated cell through the pipe;

activating the getters arranged in the pipe;

introducing gas into the cell through the pipe while removing impurities by the activated getters; and cutting the pipe in the vicinity of the cell and sealing the cell after introducing gas.

According to the above-mentioned method, since the activated getters absorb impurities mixed into gas to be introduced into the interior of the cell, gas containing almost no impurity can be introduced into the cell.

The cell may comprise a plate-like panel having a space in its interior.

The cell may form a part of a plasma display panel, having electrodes for discharging arranged on its inner surfaces and a space into which gas is to be filled, and the gas to be filled into the cell may be a the discharge gas;

The getters may be of low-temperature activation type. In this case, the heating heats the cell, the getters and the portion of the pipe which is located between the cell and the getters.

The exhausting may exhaust gas from the cell through the heated and activated getters.

The getters may be of high-temperature activation type and non-vaporization type. In this case, the heating heats the cell and the portion of the pipe which is located between the cell and the getters, and the getter activating activates the getters by heating the getters.

In this case, the getter activating heats the getters by getter heating devices provided in the vicinity of the getters, to activate the getters.

The exhausting exhausts the cell until pressure of the cell reaches a predetermined value, and the gas introducing may introduce gas until pressure of the cell reaches the predetermined value.

The at least one pipe may include an exhaust pipe connected to the cell and an introduction pipe connected to the cell, the getters are arranged in the exhaust pipe, the exhausting exhausts gas from the cell through the exhaust pipe, and the gas introducing may introduce gas into the cell through the introduction pipe.

In this case, the exhausting may heat the cell and the portion of the exhaust pipe which is located between the cell and the getters so as to exhaust the cell, and heat a vicinity of the cell of the introduction pipe. Also, the introduction pipe has getters arranged in a line, and the heating may heat at least the cell and the portion of the exhaust pipe which is located between the cell and the getters, and a portion of the introduction pipe which is located between the cell and the getters.

In order to achieve the above object, according to a second aspect of this invention, there is provided a gas filling device, which exhausts an interior of a cell and fills gas into the cell after the end of exhaust, the gas filling device comprising:

a heating furnace in which the cell is to be provided;

an exhaust pipe to be connected to the cell provided in the heating furnace;

an exhausting device connected to the exhaust pipe;

an introduction pipe to be connected to the cell provided in the heating furnace;

getters arranged in the introduction pipe; and a gas supply source connected to the introduction pipe.

According to the above-described device, the exhausting pipe is used at the time of exhaustion from the interior of the cell, while the introduction pipe is used at the time of gas introduction into the cell. Even if the impurities diffuse into the introduction pipe at the time of the exhaustion, the activated getters absorb the diffusing impurities. This ensures the introduction of a highly pure gas into the cell.

The heating furnace heats the cell and a cell-side portion of the exhaust pipe and a cell-side portion of the introduction pipe, the exhausting device exhausts gas from the heated cell through the heated exhaust pipe, and the gas supply source supplies gas to the exhausted cell while removing impurity gases by activated getters.

The exhaust pipe may have second getters arranged therein.

The getters may be of a low-temperature activation type. In this case, the getters may be arranged in the heating furnace.

The getters may be of a high-temperature activation type. In this case, the gas filling device may further comprise a getter heating section which heats the getters before the gas supply source supplies gas to the cell.

The exhaust pipe and the introduction pipe may form a single common pipe. In this case, the getters are arranged in the common pipe, the exhausting device exhausts the cell heated by the heating furnace through the common pipe, and the gas supply source supplies gas to the cell through the common pipe while removing impurity gases by the getters.

In order to achieve the above object, according to a third aspect of this invention, there is provided a method for filling discharge gas into a plate-like plasma display panel having irregularities formed on its inner surfaces, the method comprising the steps of:

providing a panel to which a pipe having getters arranged in a line is connected;

heating the panel and at least a portion of the pipe which is located between the panel and getters, so as to dissociate impurity gases absorbed on the panel and the portion;

exhausting gas through the pipe from the panel heated, so as to remove the gas from the panel, gas absorbed on an inner surface of the panel, and gas absorbed on an inner surface of heated portion of the pipe;

filling discharge gas into the panel while removing impurity gases by the getters through the pipe; and cutting and sealing the pipe after the end of filling the discharge gas into the panel.

According to the above-mentioned method, the plasma display panel can be uniformly manufactured without generating the distribution of gas components of the panel.

In order to achieve the above object, according to a fourth aspect of this invention, there is provided a method for filling discharge gas into a plate-like plasma display panel having irregularities formed on its inner surfaces, the method comprising:

exhausting gas from a panel while heating the panel; and filling discharge gas into the panel while removing impurity gas of the discharge gas by getters.

DETAILED DESCRIPTION OF THE PREFERRED EMBODIMENTS

Embodiments of the present invention will now be described with reference to the accompanying drawings.

(First embodiment)

Figure 1:
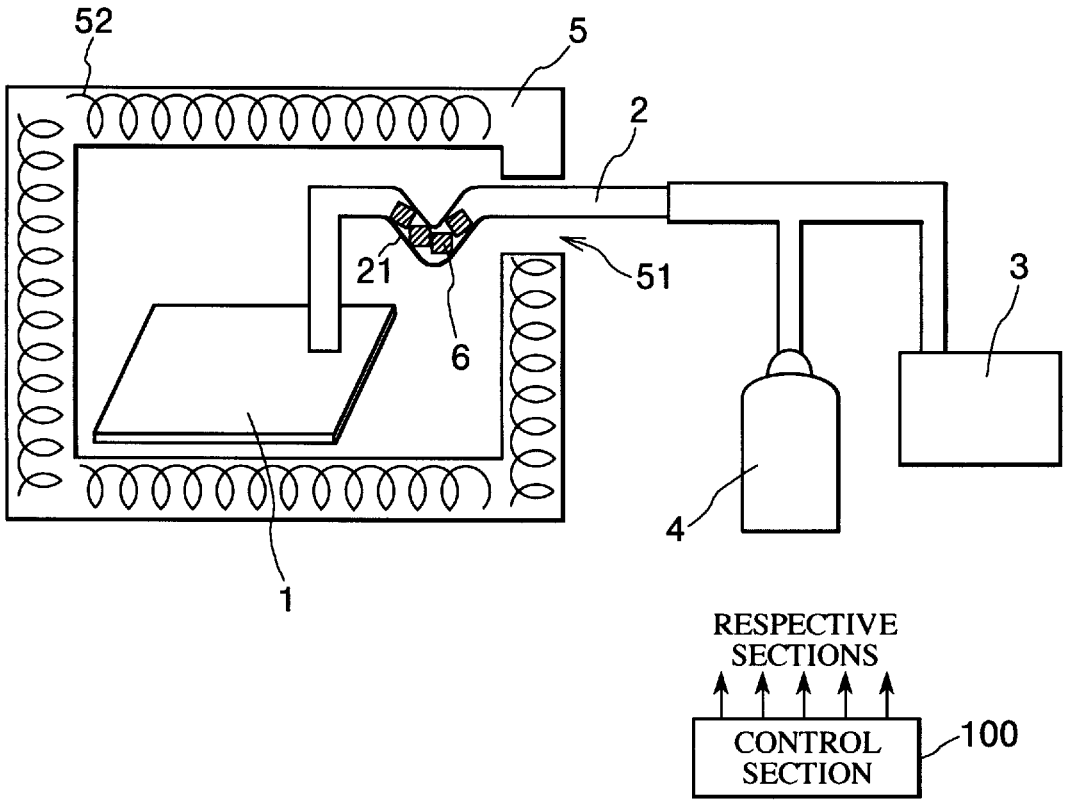
FIG. 1 is a view showing the structure of a plasma display panel manufacturing device according to a first embodiment of the present invention.

FIG. 1 is a schematic structural view of a filling device for filling discharge gas into a PDP (Plasma Display Panel) of the embodiment of this invention.

As shown in the figure, a manufacturing device comprises a vent pipe 2, an evacuating device 3, a gas cylinder 4, a heating furnace 5, getters 6, and a control section 100.

The vent pipe 2, one end of which is connected to a panel 1 (PDP being in the manufacturing process) and the other ends of which are connected to the evacuating device 3 and the gas cylinder 4, respectively, serves as a passage for gas, which is exhausted from the panel 1 and is introduced thereto. The vent pipe 2 has a bending portion 21 at which the getters 6 are provided.

The evacuating device 3 comprises a rotary pump, an ion diffusing pump, turbo-molecular pump, etc. The evacuating device 3 exhausts gas in the panel 1 through the vent pipe 2 connected thereto.

Inactive gases such as Ne (neon) gas, Xe (xenon) gas, Ar (argon) gas, and mixed gas of these gases are filled into the gas cylinder 4. The gas cylinder 4 introduces (supplies) the inactive gase (discharge gas) in to the interior (interior space) of the panel 1 through the vent pipe 2 connected thereto.

The heating furnace 5 has an opening portion 51, and a heating source 52. The panel 1 is mounted in the heating furnace 5. The vent pipe 2 is connected to the panel 1 provided in the interior of the heating furnace 5 through the opening portion 51. The bending portion 21 of the vent pipe 2 is located in the heating furnace 5. The heating source 52 comprises a radiant tube burner, an electric heater, etc, and increases temperature of the furnace (inner temperature).

The getters 6 comprise non-vaporization type getters such as non-ZrAl (zirconium aluminum) alloy, MgAI (magnesium aluminum) alloy, etc. The getters 6 are heated and activated, thereby absorbing (sucking up) impurities such as water, carbon dioxide, nitrogen gas, carbon dioxide gas, etc (hereinafter referred to as impurity gases).

The control section 100 controls the respective sections of the manufacturing device, for example, it controls the start and the stop of the driving of the evacuating device 3, gas cylinder 4, heating furnace 5.

Figure 3:
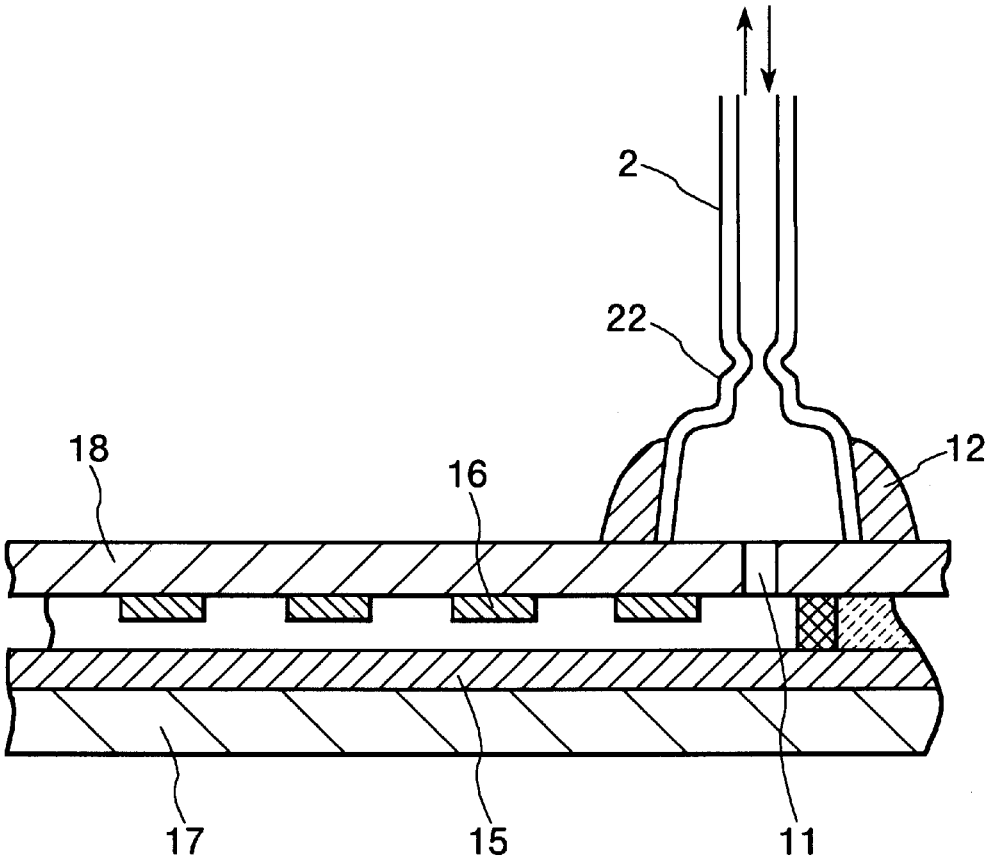
FIG. 3 is a sectional view showing the plasma display panel and an exhaust pipe.

As shown by the cross section of FIG. 3, the panel 1 is formed by bonding substrates 17 and 18, which have an anode 15 and a cathode 16, respectively. An opening 11 for a gas exhaust and a gas filling is formed at an end portion of the substrate 18. One end of the vent pipe 2 is connected to the opening 11 by a glass 12 with a low melting point.

Figure 2:
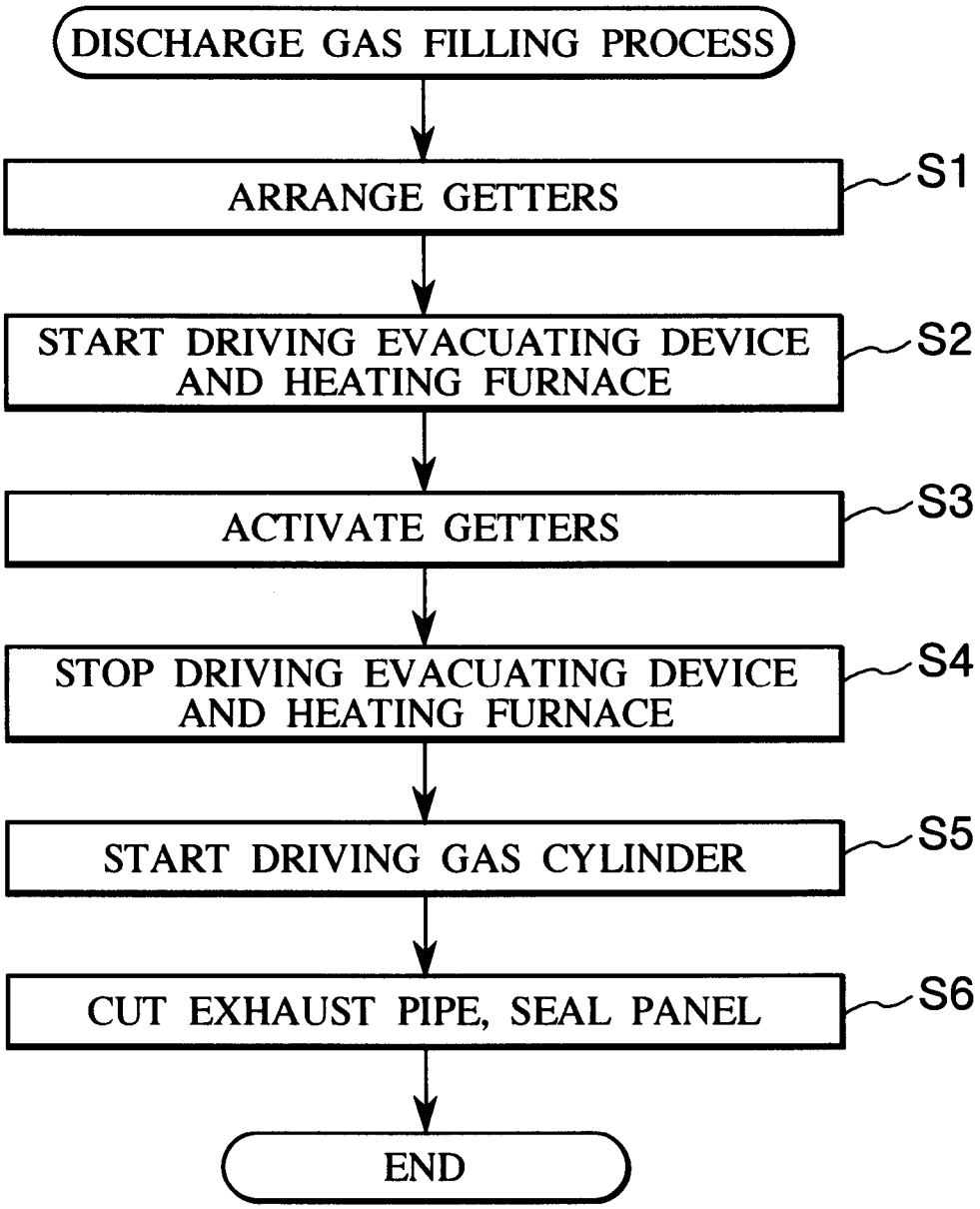
FIG. 2 is a flowchart explaining the process of filling discharge gas into the plasma display panel using the manufacturing device of FIG. 1.

FIG. 2 is a flowchart explaining the process of filling discharge gas into the panel 1 using the manufacturing device shown in FIG. 1. The filling process will be explained with reference to FIG. 2.

First, the panel 1 is placed in the heating furnace 5, and one end of the vent pipe 2 is connected to the opening 11 of the panel 1.

Also, non-vaporization type getters 6 of low-temperature activation type are arranged in the bending portion 21 of the vent pipe 2 existing in the heating furnace 5 (Step S1).

The evacuating device 3 and the heating furnace 5 are driven (Step S2).

The heating furnace 5 increases the inner temperature of the furnace, so that the panel 1 is also heated. Then, gas in the panel 1 expands and gas adhered and absorbed on the inner surface of the panel 1 is dissociated, and vacuumed by the evacuating device through the vent pipe 2. Thus, impurity gases existing in the panel 1 are heated and exhausted.

The part of the vent pipe 2, which is in the heating furnace 5, is also heated, so that gas adhered and absorbed on the inner surface is exhausted. Moreover, gas exhausted from the panel 1 is not adhered onto the inner surface of the vent pipe 2.

The getters 6 arranged in the bending section 21 of the vent pipe 2 in the heating furnace 5 are also heated and activated so as to absorb impurity gases flowing in the vent pipe 2 (Step S3). It should be noted that the amount of gas exhausted and discharged from the panel 1 and the heated portion of the vent pipe 2 is enormous and a part of the impurity gases reaches the evacuating device 3, and adhered and absorbed on the inner surface of the non-heated portion of the vent pipe 2.

When pressure of the panel 1 reaches a fixed value, the exhaust of the panel 1 is ended, and the drive of the evacuating device 3 is stopped. Thereafter, the heating furnace 5 is stopped (Step S4). By the stop of the heating furnace 5, the temperature of the heating furnace 5 itself decreases. Also, by air introduced from the opening portion 51, the inner temperature of the heating furnace 5 decreases. The decrease in the inner temperature causes the panel 1 to be cooled.

After stopping the drive of the evacuating device 3, the gas cylinder 4 is driven so as to introduce discharge gas into the panel 1 through the vent pipe 2 (Step S5).

At this time, impurity gases, which have been absorbed on the inner wall of the non-heated portion of the vent pipe 2 at the exhausting time, are dissociated by discharge gas to be introduced, and such impurity gases are mixed into discharge gas. However, the impurity gases mixed into the discharge gas are absorbed and removed from the discharge gas by the getters 6, which exceed activation temperature by the rise in temperature of the heating furnace 5 and are activated. For this reason, only discharge gas into which almost no impurity gases are mixed is introduced into the panel 1. Since the inner wall of the portion of the vent pipe 2, which is from the portion where the getters 6 are arranged to the portion, which is connected to the panel 1, is heated at the time of exhausting the panel 1, impurity gases are not absorbed on the inner wall. For this reason, impurity gases are not mixed into the discharge gas introducing into the panel 1.

After the end of introducing the discharge gas into the panel 1, the vent pipe 2 is heated and melted by a gas burner, etc. to be cut at an arbitrary portion between the portion where the getters 6 are arranged and the portion connected to the panel 1. Also, the panel 1 is sealed (Step S6). A throttling portion 22 for cutting is formed at the end portion of the vent pipe 2 in advance as shown in FIG. 3.

In the aforementioned discharge gas filling method, the vent pipe 2 used to exhaust the panel 1 (more, specifically, gas in the inner space of the panel 1) in step S2 and the vent pipe 2 used to introduce the discharge gas to the panel 1 in step S5 are the same. However, as mentioned above, the impurity gases mixed into the discharge gas are absorbed by the getters 6, which exceed activation temperature by the rise in temperature of the heating furnace 5 and are activated. Thereafter, the impurity gases are removed from the discharge gas. Moreover, the inner wall of the vent pipe 2, which is from the getters 6 to the panel 1, is heated at the time of evacuating the panel 1. For this reason, the impurity gases are not mixed into the discharge gas introducing into the panel 1.

The specific structure of the manufacturing device shown in FIG. 1 will be explained with reference to FIGS. 4 to 6.

Figure 4:
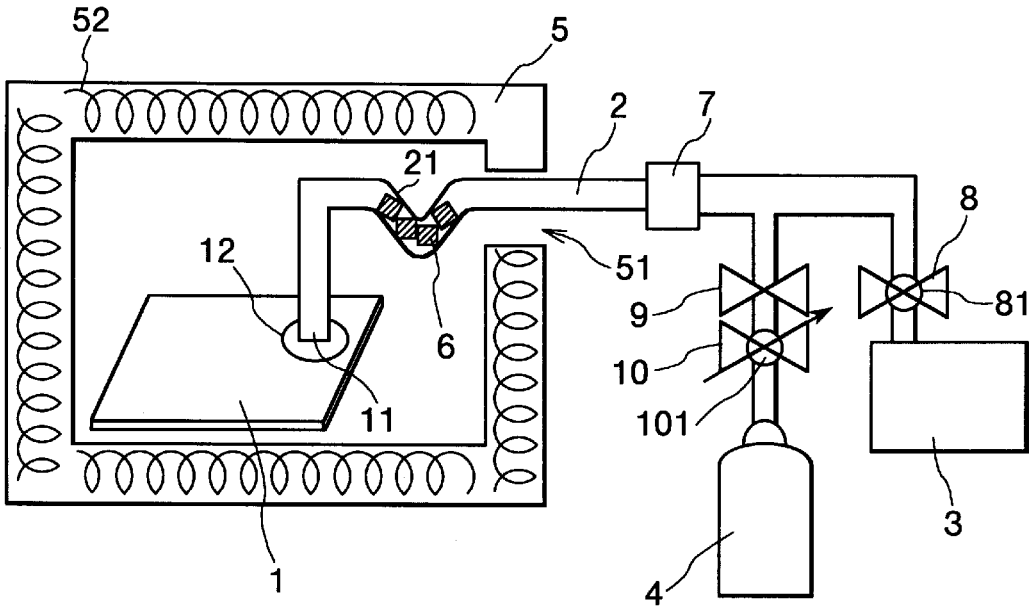
FIG. 4 is a view showing a specific structure of the manufacturing device of the first embodiment.

FIG. 4 is one example of the specific structure of the manufacturing device shown in FIG. 1.

The manufacturing device comprises the vent pipe 2, the evacuating device 3, the gas cylinder 4, the heating furnace 5, getters 6, a connecting device 7, an exhaust valve 8, a gas introducing valve 9, and an adjusting valve 10.

The vent pipe 2, the evacuating device 3, the gas cylinder 4, the heating furnace 5, and getters 6 have substantially the same structure as the members and the device explained with reference to FIG. 1.

The connecting device 7, one end of which is connected to the vent pipe 2 and the other end is connected to the evacuating device 3 and the gas cylinder 4. The connection device switches the evacuating device 3 and the gas cylinder 4 to achieve conduction with the vent pipe 2. The connecting device 7 may be located at the connecting portion of the pipes connected to the evacuating device 3 and the gas cylinder 4.

The exhaust valve 8 is an on-off valve with a vacuum gauge 81 that carries out the opening (start exhausting) and closing (end exhausting) of the evacuating device 3, and adjustment of the amount of exhaust.

The gas introducing valve 9 is an on-off valve that carries out the opening (start introducing discharge gas) and closing (end introducing discharge gas) of the gas cylinder 4.

The adjusting valve 10 having a pressure gauge 10*a* adjusts pressure of the discharge gas to be introduced into the panel 1 from the gas cylinder 4.

The vicinity of the exhaust hole 11 of the sealing panel 1 is coated with the glass 12 with a low melting point. Then, as shown in FIG. 3, the sealing glass 12 is heated and melted so that the exhaust hole 11 of the panel 1 and the vent pipe 2 are connected to each other airtightly.

The following will explain the process of manufacturing a PDP using the manufacturing device shown in FIG. 4 based on the specific example.

In this example, there are used getters (for example, made by Saesu Getters Japan Inc.,), each which has a cylindrical shape with a diameter of 2 mm and a height of 2 mm, is activated by heating at 350° C. for one hour or more. Also, the vent pipe 2 having an inner diameter of 4 mm is used.

The exhaust valve 8 is opened, and the evacuating device 3 is driven, so that the panel 1 is evacuated through the vent pipe 2. At this time, the gas introducing valve 9 is in a closed state.

When the vacuum gauge 81 shows, for example, 0.1 Pa or less, the heating furnace 5 is driven (energized) to start the heating. By the increase in the inner temperature of the heating furnace 5, the panel 1 is heated and exhausted, and the getters 6 provided in the vent pipe 2 of the heating furnace 5 are heated.

The getters 6 are continued to be heated for at least one hour or more after the activation temperature of the getters 6 reaches 350° C., for example, five hours. The impurity gases existing in the panel 1 are exhausted to the evacuating device 3 through the vent pipe 2 by the above heating and exhausting.

After a lapse of five hours, the heating of the heating furnace 5 is stopped, and the inner temperature is reduced by air introduced from the opening portion 51 of the heating furnace 5.

When the inner temperature of the heating furnace 5 reaches substantially the same value as the outer temperature, for example, 40° C. or less, the exhaust valve 8 is closed.

The connecting device 7 is operated to switch the evacuating device 3 connected to the vent pipe 2 to the gas cylinder 4 to be connected to the vent pipe 2. Then, the gas introducing valve 9 is opened to introduce the discharge gas into the panel 1 through the vent pipe 2.

When the pressure gauge 101 of the adjusting valve 10 shows, for example, 50 kPa as pressure of discharge gas, the gas introducing valve 9 is closed to stop the introduction of discharge gas.

After the end of introducing the discharge gas, the vent pipe 2 is heated and melted by the gas burner, etc. to be cut at an arbitrary portion between the bending portion 21 where the getters 6 are arranged and the portion connected to the panel 1. Then, the panel 1 is separated from the evacuating device 3.

Even if the aforementioned method is used, temperature of the inner wall that part of the vent pipe 2 which projects outward from the opening portion 51 of the heating furnace 5, is low. For this reason, the part of the exhausted impurity gases is absorbed on the inner wall of the vent pipe 2. Then, the impurity gases absorbed on the inner wall of the vent pipe 2 are dissociated from the inner wall by the discharge gas supplied from the gas cylinder 4 and mixed into the discharge gas. The impurity gases (impurities) mixed into the discharge gas are absorbed and removed by the getters 6, which are arranged in the bending portion 21 of the vent pipe 2 and which are activated, before being introduced into the panel 1.

Therefore, the impurity gases are not contained in the discharge gas to be introduced into the panel 1.

In order to effectively absorb the impurity gases, the number of getters 6 arranged in the vent pipe 2 and the density of the getters can be increased. However, if the number of getters 6 or the density is increased too much, the exhaust efficiency becomes law. As a result, the efficiency of exhausting the PDP worsens.

Since the interior of the panel 1 is formed of anode 15 and cathode 16 with a distance of about 100 $\mu$m, exhaust resistance to the vent pipe 2 with an inner diameter of 4 mm is extremely high. For this reason, even if about ten getters each having a diameter of 2 mm and a height of 2 mm are arranged, the exhaust efficiency of the panel 1 does not decrease.

Therefore, in a case where eight to twelve getters 6, for example, ten getters are arranged in the vent pipe 2, the discharge gas is introduced at speed of about 0.1 kPa/second. This makes it possible to remove the impurity gases dissociated from the inner wall of the vent pipe 2 from the discharge gas.

The size of the vent pipe, the number of getters to be arranged, and pressure of discharge gas to be introduced are arbitrarily changeable without being limited to the aforementioned case.

Thus, according to the first embodiment, since the activated getters absorb the impurity gases mixed into the discharge gas to be introduced into the panel, the discharge gas with high purity can be introduced into the panel.

(Second embodiment)

In the above-explained embodiment, the discharge gas was introduced by the vent pipe used at the time of exhausting the interior of the panel. However, the pipe to be used at the exhausting time and the pipe to be used at the discharge gas introducing time may be employed individually. Such a manufacturing device will be specifically explained with reference to FIG. 5.

This manufacturing device comprises evacuating device 3, gas cylinder 4, heating furnace 5, getters 6, connecting devices 7*a*, 7*b*, exhaust valve 8, gas introducing valve 9, adjusting valve 10, an introduction pipe 102*a*, and an exhaust pipe 102*b*.

The evacuating device 3, gas cylinder 4, heating furnace 5, getters 6, connecting devices 7*a*, 7*b*, exhaust valve 8, gas introducing valve 9, and adjusting valve 10 are the same as the device explained with reference to FIG. 4.

The introduction pipe 102*a* is structured such that one end is connected to an introducing hole 11*a* and the other end is connected to the connecting device 7*a*. Then, gas to be charged by the gas cylinder 4 is introduced into the panel 1 through an introducing hole 11*a*. The introduction pipe 102*a* has a bending portion 21*a* for arranging getters 6.

The exhaust pipe 102*b* is structured such that one end is connected to an exhaust hole 11*b* and the other end is connected to the connecting device 7*b*. Then, the evacuating device 3 carries out exhaust through the exhaust hole 11*b*.

Figure 5:
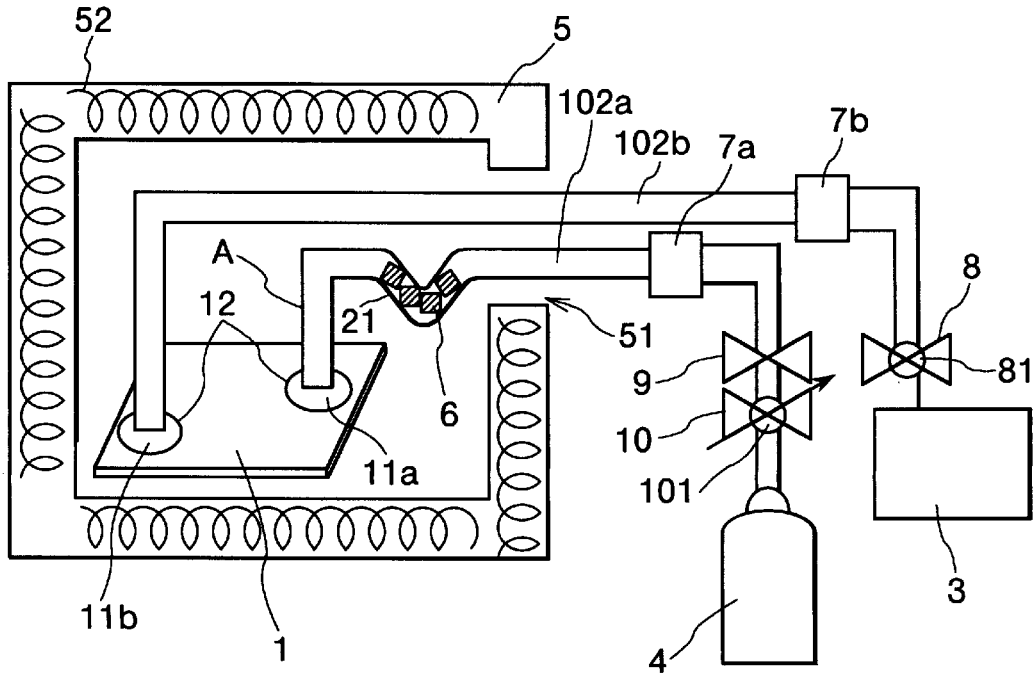
FIG. 5 is a view showing the structure of a plasma display panel manufacturing device according to a second embodiment of the resent invention.

The following will explain the process of manufacturing a PDP using the manufacturing device shown in FIG. 5.

The heating furnace 5 is driven to increase the inner temperature up to 350° C. such that the panel 1 and getters 6 are heated. Also, the evacuating device 3 is driven to evacuate the panel 1 through the exhaust hole 11*b* and the exhaust pipe 102*b*. After the end of evacuating the panel 1, the heating furnace 5 is cooled. Then, the gas cylinder 4 is driven to introduce the discharge gas through the introduction pipe 102*a* and the introducing hole 11*a*.

In the aforementioned manufacturing method, the exhausting pipe 102*b* is used only when the panel 1 is evacuated and the introduction pipe 102*a* is used only when the discharge gas is introduced into the panel 1. For this reason, the flow of the impurity gases to be exhausted and that of the discharge gas to be introduced are one way.

While the panel 1 is being evacuated through the exhaust pipe 102*b*, the introduction pipe 102*a* is also exhausted through the panel 1 and the exhaust pipe 102*b*. However, the exhaust efficiency of the introduction pipe 102*a* is low. Therefore, when the amount of discharged gases (gas to be exhausted) after the panel 1 is started to be exhausted is large, the impurity gases of the panel 1 are diffused (introduced) into the introduction pipe 102*a*.

The diffused impurity gases are absorbed on the portion where the temperature of the introduction pipe 102*a* is low, that is, the inner wall of the portion of the introduction pipe 102*a* projected from the heating furnace 5.

When the gas cylinder 4 introduces the discharge gas to the panel 1 through the introduction pipe 102*a*, the getters 6 can absorb and remove the impurity gases mixed to the discharge gas. Therefore, the impurity gases dissociated from the inner wall of the exhaust pipe 102*b* can be removed from the discharge gas.

Thus, according to the second embodiment, since the activated getters 6 absorb the impurity gases diffused into the introduction pipe 102*a* at the exhausting time, the discharge gas with high purity can be introduced into the PDP.

Figure 6:
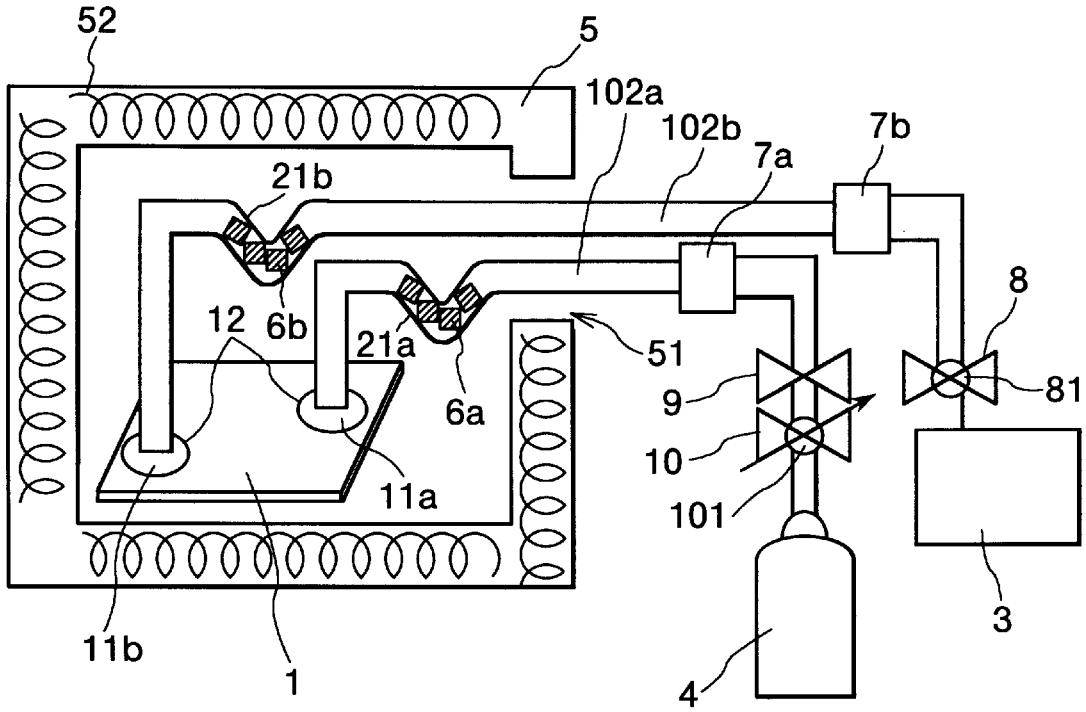
FIG. 6 is a view showing the other structure of the plasma display panel manufacturing device according to the second embodiment of the present invention.

The manufacturing device shown in FIG. 5 may be replaced with the manufacturing device as shown in FIG. 6.

The manufacturing device of FIG. 6 has the same structure as that of the manufacturing device of FIG. 5. However, a bending portion 21*b* for arranging the getters are provided in the exhaust pipe 102*b*, and the getters 6*b* are arranged in the bending portion 21*b*.

By this structure, when the gas cylinder 4 introduces the discharge gas to the panel 1, the impurity gases absorbed on the inner wall of the exhaust pipe 102*b* can be prevented from entering the panel 1 after being diffused.

Also, in the manufacturing devices shown in FIG. 5 or FIG. 6, after evacuating the panel 1, the exhaust pipe 102*b* is heated and melted by a gas burner, etc. to be cut at an arbitrary portion connected to the panel 1. Also, the panel 1 is sealed. Thereafter the discharge gas may be introduced.

(Third embodiment)

The above-mentioned embodiment used low-temperature activation type and non-vaporization type getters 6, which were activated at temperature used when the panel was heated. However, the getters to be used are not limited to the above getters. For example, it is possible to use high-temperature activation type and non-vaporization type getters, which are not activated at temperature used when the panel is heated. The manufacturing device using the high activation type and non-vaporization type getters will be specifically explained with reference to FIG. 7.

Figure 7:
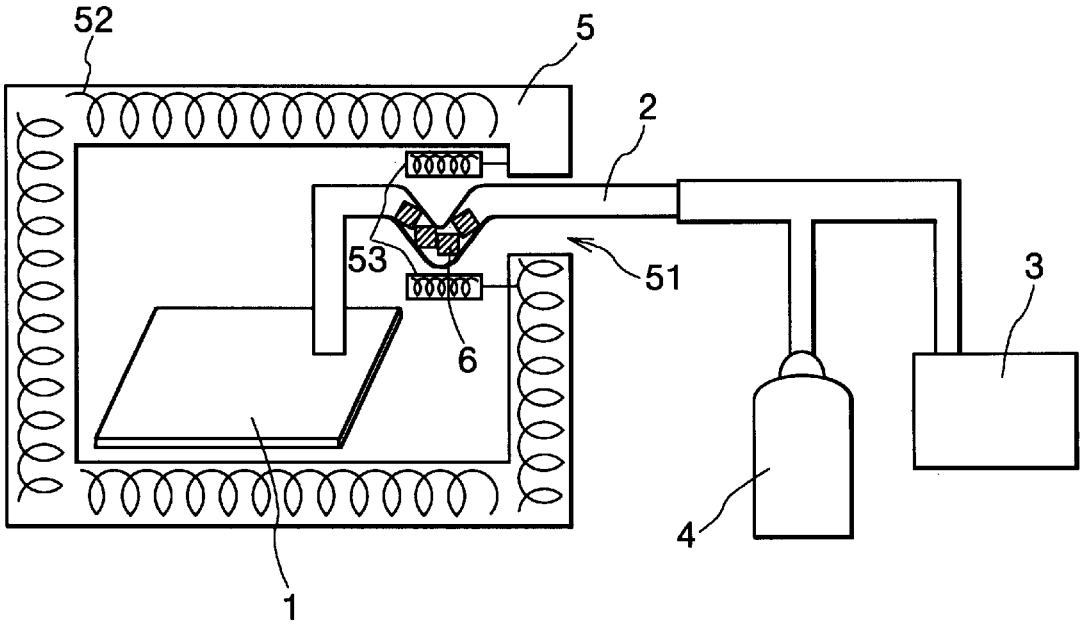
FIG. 7 is a view showing the structure of a plasma display panel manufacturing device according to a third embodiment of the present invention.

As shown in FIG. 7, getter heating devices 53 such as high-frequency induction heating devices for heating getters, are arranged in the vicinity of the getters 6 arranged in the bending portion 21 of the vent pipe 2.

In the above-structured manufacturing device, after the end of evacuating the panel 1, the getter heating devices 53 are driven so that the getters 6 are heated and activated. After that, similar to the first and second embodiments, the panel is cooled and the discharge gas is introduced.

Thus, according to the third embodiment, the getters to be used are not limited to the low activation type, and the high activation type can be used.

Also, the getter heating devices 53 may be driven at the time of heating the panel 1.

Moreover, the getter heating devices may be arranged in the vicinity of the bending portions of the exhaust pipe and the introduction pipe provided in the manufacturing devices shown in FIG. 5 and FIG. 6.

Furthermore, the object into which gas containing almost no impurity gases is filled is not limited to the plasma display panel. Also, the gas to be filled is not limited to the discharge gas. For example, the gas filling object includes the general cells into which gas with high purity is filled such as a fluorescent tube. The shape of the cell is not limited to the panel shape, and a cylindrical cell or a spherical cell may be used.

Moreover, the position of gettters may be movably set. For example, in the structure of FIG. 1, the getters 6 may be pulled out to the outer section of the heating furnace 5 at the exhausting time and put thereto at the discharge gas introducing time.

What is claimed is:

1. A method for filling gas into a cell comprising the steps of:

providing a furnace, to enclose the cell and at least one pipe which passes through a wall of the furnace and connects to the cell, a portion of at least one of the at least one pipe having getters contained therein, the getter-containing pipe portion being connected to the cell through a connecting pipe portion;

exhausting an interior of the heated cell through one of said at least one pipe, at least a portion of the exhaust pipe being contained within the furnace and heated by the furnace during said exhausting;

introducing gas into said cell through one of said at least one pipe, the introduction pipe comprising said getter-containing portion, the getter-containing pipe portion and the connecting pipe portion being contained entirely within and heated by the furnace, the getters being activated by said heating and removing impurities from the gas being introduced into the cell; and cutting said pipe in the vicinity of said cell and sealing said cell after introducing gas.

2. The method according to claim 1, wherein said cell comprises a plate-like panel having a space in its interior.

3. The method according to claim 1, wherein said cell forms a part of a plasma display panel having electrodes for discharging arranged on its inner surfaces and a space into which the gas is to be filled, the gas to be filled into said cell being a discharge gas.

4. The method according to claim 1, wherein said getters are of low-temperature activation type.

5. The method according to claim 4, wherein said exhaust pipe comprises said getter-containing portion and said connecting pipe portion, said getters being heated and activated during said exhausting.

6. The method according to claim 1, wherein said getters are of high-temperature activation type and non-vaporization type.

7. The method according to claim 6, wherein a temperature of said getters is increased by use of getter heating devices provided in a vicinity of said getters.

8. The method according to claim 1, wherein said exhausting continues until pressure of said cell reaches a predetermined value, and said gas introducing continues until pressure of said cell reaches said predetermined value.

9. The method according to claim 1, wherein said exhaust pipe and said introduction pipe are separate pipes individually connected to said cell, one of said at least one getter-containing section being contained within said exhaust pipe.

10. The manufacturing method according to claim 9, wherein during the exhausting step, the getter-containing portion and the connecting pipe portion of both said exhaust pipe and said introduction pipe are heated by the furnace.

11. The manufacturing method according to claim 10, wherein said introduction pipe has getters arranged in a line, and said heating heats at least said cell, said portion of said exhaust pipe which is located between said cell and said getters, and a portion of said introduction pipe which is located between said cell and said getters.

12. A gas filling device for exhausting and subsequently filling a cell, said gas filling device comprising:

a heating furnace being structured to enclose said cell;

at least one pipe to be connected to said cell provided in said heating furnace;

an exhaust device connected to one of said at least one pipe;

a gas supply source connected to one of said at least one pipe; and getters arranged in a portion of said at least one pipe connected to said gas supply, said getters being contained within said furnace.

13. The gas filling device according to claim 12, wherein said at least one pipe connected to said exhaust device includes a portion containing getters arranged therein.

14. The gas filling device of claim 13, wherein the exhaust device is arranged with respect to the cell so that the gas passing from the cell to the exhaust device must pass through the getters-containing section of the at least one pipe connected to the exhaust device.

15. The gas filling device according to claim 12, wherein said getters are of a low-temperature activation type.

16. The gas filling device according to claim 12, wherein said getters are of a high-temperature activation type, said gas filling device further comprising a getter heating element separate from a heating element of the furnace.

17. The gas filling device according to claim 12, wherein there is only one said at least one pipe, said pipe being connected to both the exhaust device and the gas supply source, said getters being arranged in said single pipe.

18. The gas filling device of claim 17, wherein said only one pipe, said exhaust device, and said gas supply source are arranged with respect to the cell so that both the gas passing from the gas supply source to the cell and gas passing from the cell to the exhaust device must pass through getters-containing section of said only one pipe.

19. The gas filling device of claim 12, wherein the getters-containing portion of the at least one pipe is connected to the cell by a connecting pipe portion, the connecting pipe portion being entirely contained within the furnace.

20. The gas filling device of claim 19, wherein the gas supply is arranged with respect to the cell so that the gas passing from the gas supply to the cell must pass through the getters-containing section of the at least one pipe.

21. A method for filling discharge gas into a plate-like plasma display panel having irregularities formed on its inner surfaces, the method comprising:

providing a plasma display panel connected to a pipe having a portion which contains getters;

heating the panel, said getter-containing portion, and an entire section of said pipe which is located between the panel and said getters so as to dissociate impurity gases absorbed on the panel and the heated pipe portions;

exhausting gas through said pipe from said panel heated so as to remove the gas from said panel, gas absorbed on an inner surface of said panel, and gas absorbed on an inner surface of the heated portion of said pipe;

filling discharge gas into the panel, while removing impurity gases by said getters through said pipe; and cutting and sealing said pipe after the end of filling the discharge gas into said panel.

* * * * *